US007537001B2

(12) United States Patent
Ma

(10) Patent No.: US 7,537,001 B2
(45) Date of Patent: May 26, 2009

(54) TOY GUN FOR LAUNCHING AN ELONGATED DART AND A METHOD OF USING PRESSURIZED AIR TO LAUNCH AN ELONGATED DART FROM A TOY GUN

(75) Inventor: Chor Ming Ma, Kowloon (HK)

(73) Assignee: Buzz Bee Toys, Inc., Mt. Laurel, NJ (US)

( * ) Notice: Subject to any disclaimer, the term of this patent is extended or adjusted under 35 U.S.C. 154(b) by 411 days.

(21) Appl. No.: 11/100,694

(22) Filed: Apr. 7, 2005

(65) Prior Publication Data

US 2006/0225717 A1 Oct. 12, 2006

(51) Int. Cl.
*F41B 11/00* (2006.01)

(52) U.S. Cl. ..... 124/69

(58) Field of Classification Search ..... 124/68, 124/69

See application file for complete search history.

(56) References Cited

U.S. PATENT DOCUMENTS

| | | | | | |
|---|---|---|---|---|---|
| 1,395,786 | A | * | 11/1921 | Anderson | 124/26 |
| 2,117,935 | A | * | 5/1938 | Benjamin et al. | 124/84 |
| 2,145,277 | A | * | 1/1939 | Reardon | 446/182 |
| 2,725,868 | A | * | 12/1955 | Foster | 124/65 |
| 2,856,911 | A | * | 10/1958 | Maxwell | 124/71 |
| 3,765,396 | A | * | 10/1973 | Kienholz et al. | 124/65 |
| 4,212,285 | A | * | 7/1980 | Cagan et al. | 124/67 |
| 4,819,609 | A | * | 4/1989 | Tippmann | 124/72 |
| 5,058,561 | A | * | 10/1991 | Starr | 124/65 |
| 5,115,794 | A | * | 5/1992 | Moormann | 124/65 |
| 5,161,516 | A | * | 11/1992 | Ekstrom | 124/73 |
| 5,186,156 | A | * | 2/1993 | Clayton | 124/59 |
| 5,257,614 | A | * | 11/1993 | Sullivan | 124/73 |
| 5,343,849 | A | * | 9/1994 | Steer | 124/72 |
| 5,509,399 | A | * | 4/1996 | Poor | 124/76 |
| 5,515,837 | A | * | 5/1996 | Nin et al. | 124/59 |
| 5,522,374 | A | * | 6/1996 | Clayton | 124/59 |
| 5,613,483 | A | * | 3/1997 | Lukas et al. | 124/73 |
| 5,655,509 | A | * | 8/1997 | Casas Salva | 124/66 |
| 5,680,853 | A | * | 10/1997 | Clayton | 124/66 |
| 5,690,091 | A | * | 11/1997 | Bissonnette | 124/80 |
| 5,701,879 | A | * | 12/1997 | Johnson et al. | 124/69 |
| 5,769,066 | A | * | 6/1998 | Schneider | 124/75 |
| 5,787,869 | A | * | 8/1998 | Johnson et al. | 124/69 |
| 5,813,392 | A | * | 9/1998 | McCaslin | 124/73 |
| 5,878,735 | A | * | 3/1999 | Johnson | 124/59 |
| 5,901,693 | A | * | 5/1999 | Smith | 124/66 |
| 6,119,671 | A | * | 9/2000 | Smith et al. | 124/59 |
| 6,295,752 | B1 | * | 10/2001 | Havlock | 42/76.01 |
| 2006/0225719 | A1 | * | 10/2006 | Leal et al. | 124/71 |

* cited by examiner

*Primary Examiner*—Troy Chambers
(74) *Attorney, Agent, or Firm*—Volpe and Koenig, P.C.

(57) ABSTRACT

A toy gun that uses air to launch an elongated dart having a rear bore. The toy gun barrel defines a chamber adapted to receive the elongated dart. The barrel has an inner surface which forms a restriction proximate to the second end. The restriction reduces a barrel cross-section. The barrel receives an end portion of the elongated dart therein so that the pressurized air initially pressurizes the rear bore of the elongated dart and pressurizes the chamber outside of the elongated dart between a first barrel end and the restriction as the dart is launched.

19 Claims, 3 Drawing Sheets

TOY GUN FOR LAUNCHING AN ELONGATED DART AND A METHOD OF USING PRESSURIZED AIR TO LAUNCH AN ELONGATED DART FROM A TOY GUN

BACKGROUND

The present invention is directed generally to toy guns that use air to launch an elongated, rear bore dart and, more specifically, to a toy gun having a barrel that is configured to increase the velocity with which the elongated dart is launched.

Single or multiple shot toy dart guns are often used to "shoot" elongated darts. The darts typically include a suction cup on a front end and a bore or chamber at the back end. An important consideration for selecting a toy dart gun is the distance that the toy dart can be propelled. Known toy dart guns rely on the pressure of the air that is supplied to the toy dart gun barrel to launch the dart. Minor increases in shot distance have been provided by increasing the pressure of the air supplied to the barrel. This solution has the drawback of sources of pressurized air being commonly limited by the size of the toy dart gun, the strength of the user, and by reasonable limitations on the maximum marketable toy gun cost.

It would be advantageous to provide a toy dart gun capable of "shooting" elongated darts a greater distance that can still be produced at a reasonable cost, and can be used by most users without requiring an increase in user strength over the known types of toy dart guns.

SUMMARY

Briefly stated, a first embodiment of the present invention is directed to a toy gun that uses pressurized air to launch an elongated dart having a rear bore. The toy gun includes an air pressure source. A trigger mechanism selectively controls the air pressure source. A barrel is in communication with the air pressure source and has first and second ends. The first end is positioned to receive pressurized air from the air pressure source upon activation of the trigger mechanism. The barrel defines a chamber adapted to receive the elongated dart. The barrel has an inner surface with a restriction proximate to the second end. The restriction reduces a barrel cross-section, taken in a direction generally perpendicular to a longitudinal axis of the barrel, to a size corresponding to the elongated dart. An inner post is positioned in the chamber and is located at the first end of the barrel to receive air provided to the barrel for release inside the chamber at a location spaced from the first end of the barrel. The inner post and the inner surface of the barrel form a space to receive an end portion of the elongated dart therein with a portion of the inner post locatable in the rear bore of the elongated dart so that the pressurized air released through the inner post initially pressurizes the rear bore of the elongated dart and pressurizes the chamber outside of the elongated dart between the first end and the restriction as the dart passes off of the inner post.

In a separate aspect, the present invention is directed to a method of using pressurized air to launch an elongated dart having a rear bore from a toy gun. The method includes: loading the elongated dart into the barrel of the toy gun, the barrel defining a chamber and having a first end that receives pressurized air and a second end; restricting a portion of the barrel proximate to the second end to reduce the barrel cross-section, as taken in a direction generally perpendicular to a longitudinal axis of a barrel, to increase the velocity with which the elongated dart is launched; and releasing the pressurized air into the rear bore of the elongated dart and a portion of the chamber between the first end and the restriction so that the elongated dart is propelled past the restriction.

BRIEF DESCRIPTION OF THE DRAWING(S)

The foregoing summary, as well as the following detailed description of the preferred embodiment of the present invention, will be better understood when read in conjunction with the appended drawings. For the purpose of illustrating the invention, there are shown in the drawings an embodiment which is presently preferred. It is understood, however, that the invention is not limited to the precise arrangement and instrumentality shown. In the drawings.

DETAILED DESCRIPTION OF THE PREFERRED EMBODIMENT(S)

Figure 1:
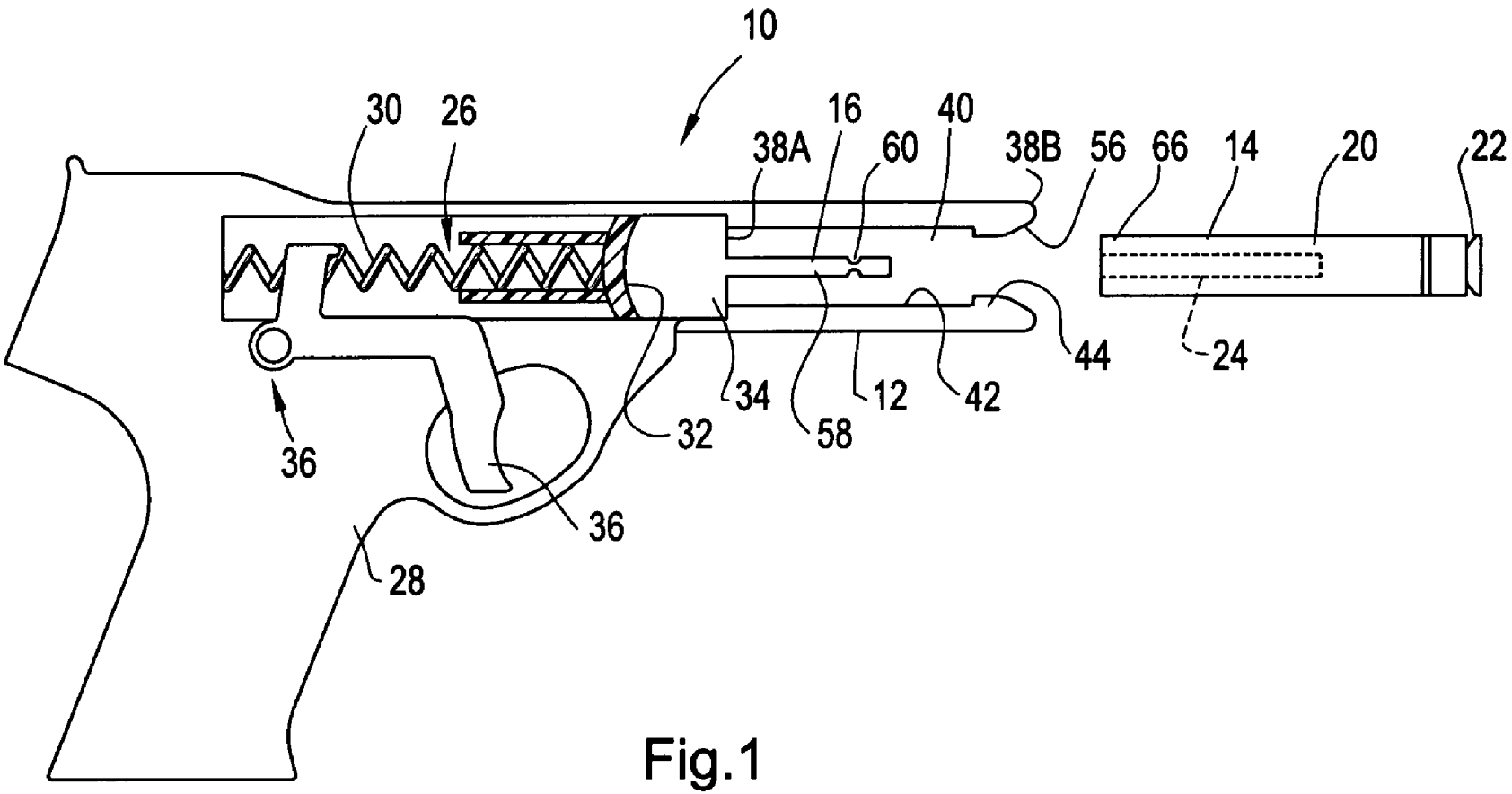
FIG. 1 is a schematic of a preferred embodiment of the toy gun of the present invention.

Certain terminology is used in the following description for convenience only and is not limiting. The words "right", "left", "top" and "bottom" designate directions in the drawings to which reference is made. The words "inwardly" and "outwardly" refer to directions toward and away from, respectively the geometric center of the toy gun and designated parts thereof. The term "toy gun," as used in the specification and in the claims, means "any one of a toy pistol, toy revolver, toy firearm, toy shotgun, toy rifle, toy semiautomatic weapon, and toy automatic weapon." The words "a" and "one", as used in the claims and in the corresponding portions of the specification, are defined as including one or more of the referenced item unless specifically stated otherwise. This terminology includes the words above specifically mentioned, derivatives thereof, and words of similar import.

Referring to FIGS. 1-8, wherein like numerals indicate like elements throughout, a preferred embodiment of a toy dart gun is shown and designated 10. Briefly stated, the toy dart gun 10 includes a barrel 12 having a restriction 44 therein that increases the pressure with which an elongated dart 14 is launched.

It is preferred that the toy gun 10, and its component parts, are made from a sturdy, durable, light weight material, such as a suitable polymer or plastic. However, steel, metal, alloy, aluminum or any suitable material may also be used for the toy gun 10 without departing from the present invention.

Referring to FIG. 1, the toy gun 10 uses air to launch the elongated dart 14. The elongated dart 14 preferably has a cylindrical, foam body 20 and a suction cup 22 mounted on a front end thereof. The dart 14 has a rear bore 24 for placement over an inner post 16 (further described below) that is located in the toy gun barrel 12.

The toy gun 10 includes an air pressure source 26 which is preferably housed within the gun body 28. It is preferred that the air source 26 include a biasing member 30 and plunger 32 for providing pressurized air. The plunger 32 is preferably slidably positioned within a bore 34 such that rapid forward motion of the plunger 32 compresses air for launching the dart 14. Alternatively, the air pressure source 26 may be a reservoir of pressurized air stored in the gun body 28, a detachable pressurized gas cylinder, or may be any other known air source suitable for use with toy dart guns without departing from the scope of the present invention.

A trigger mechanism 36 selectively controls the air pressure source 26. While a simple cantilever trigger mechanism is shown, those of ordinary skill in the art will appreciate that any known, suitable trigger mechanism for use with toy dart guns can be incorporated into the toy gun 10 of the present invention.

Figure 2:
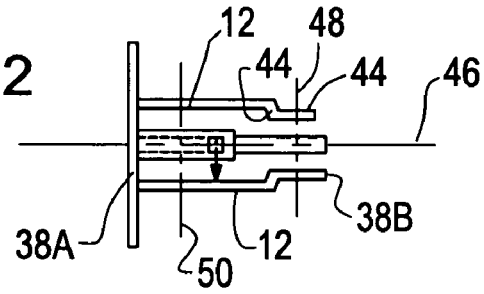
FIG. 2 is a schematic of a barrel of the toy gun of FIG. 1.
Figure 3:
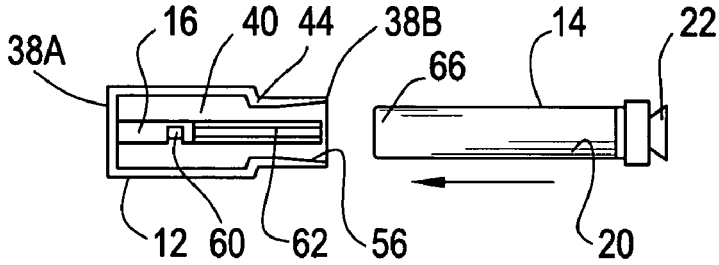
FIG. 3 is a broken away, partial cross-sectional view of the barrel of the toy gun of FIG. 1 illustrating an elongated dart prior to insertion therein.
Figure 5:
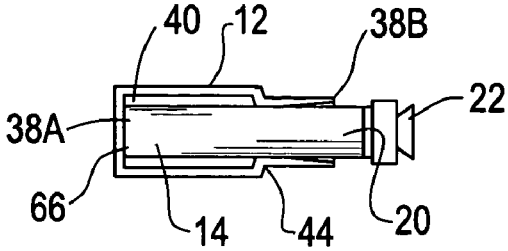
FIG. 5 is a broken away, partial cross-sectional view of the barrel of the toy gun of FIG. 1 illustrating the elongated dart fully inserted therein.
Figure 7:
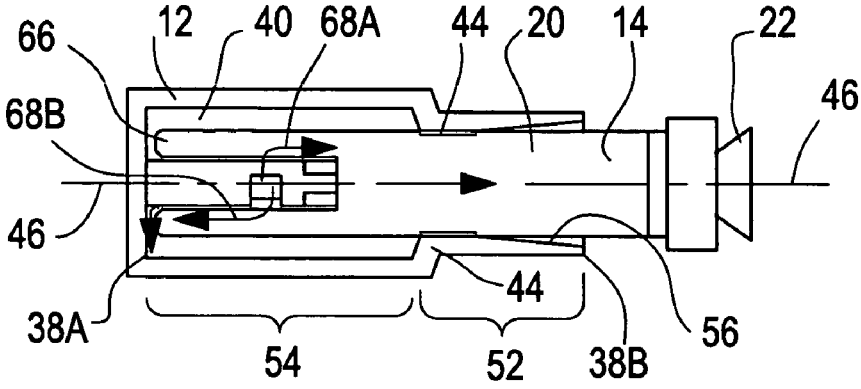
FIG. 7 is a broken away, partial cross-sectional view of the barrel of the toy gun of FIG. 1 illustrating the flow of air within the chamber during launch of the dart.

Referring to FIGS. 2 and 3, the barrel 12 has first and second ends 38A, 38B. As shown in FIG. 1, the first barrel end 38A is positioned to receive pressurized air from the air pressure source 26 upon activation of the trigger mechanism 36. Referring to FIGS. 5 and 7, the barrel 12 defines a chamber 40 adapted to receive the elongated dart 14.

Figure 4:
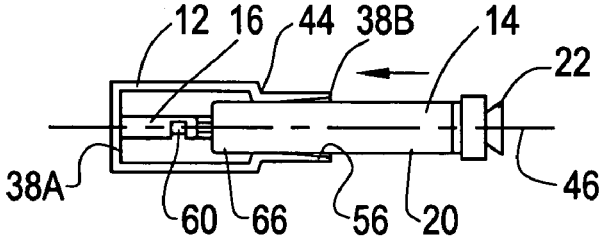
FIG. 4 is a broken away, partial cross-sectional view of the barrel of the toy gun of FIG. 1 illustrating the elongated dart partially inserted therein.

As best shown in FIG. 1, the barrel 12 has an inner surface 42 with a restriction 44 proximate to the second barrel end 38B. The restriction 44 is formed by a portion of the barrel inner surface 42 extending radially inwardly to form a lip or ridge that extends around the chamber 40. Referring to FIG. 4, the restriction reduces a barrel cross-section, taken in a direction generally perpendicular to a longitudinal axis 46 of the barrel 12, to a size corresponding to a diameter of the elongated dart 14.

Referring to FIG. 2, it is preferred that a restriction cross-sectional area 48 (i.e., the area bounded by an inner surface of the restriction as taken along the line 48 in FIG. 2), as measured generally perpendicular to the longitudinal axis 46 of the barrel 12, is between approximately fifty (50%) percent and approximately seventy (70%) percent of an unrestricted barrel cross-sectional area 50 (i.e., the area bounded by the inner surface 42 of the barrel 12 in an unrestricted portion thereof), as measured generally perpendicularly to the longitudinal axis 46. Preferably the restriction cross-sectional area 48 (i.e., the area bounded by an inner surface of the restriction as taken along the line 48 in FIG. 2), as measured generally perpendicular to the longitudinal axis 46 of the barrel 12, is between approximately sixty (60%) percent and approximately sixty-five (65%) percent (more preferred still is approximately sixty-two (62%) percent) of an unrestricted barrel cross-sectional area 50 (i.e., the area bounded by the inner surface 42 of the barrel 12 in an unrestricted portion thereof), as measured generally perpendicularly to the longitudinal axis 46.

Referring to FIG. 7, it is preferred that a length 52 of the restriction, as measured generally parallel to the longitudinal axis 46 of the barrel 12 is between approximately ten (10%) percent and approximately thirty (30%) percent of a length of the barrel 12 as measured generally parallel to the longitudinal axis 46 (the length of the barrel is equal to the length 52 of the restriction 44 and the length 54 of the remaining portion of the barrel 12). More preferably, the length 52 of the restriction, as measured generally parallel to the longitudinal axis 46 of the barrel 12 is approximately twenty (20%) percent of the length of the barrel 12 as measured generally parallel to the longitudinal axis 46.

Figure 8:
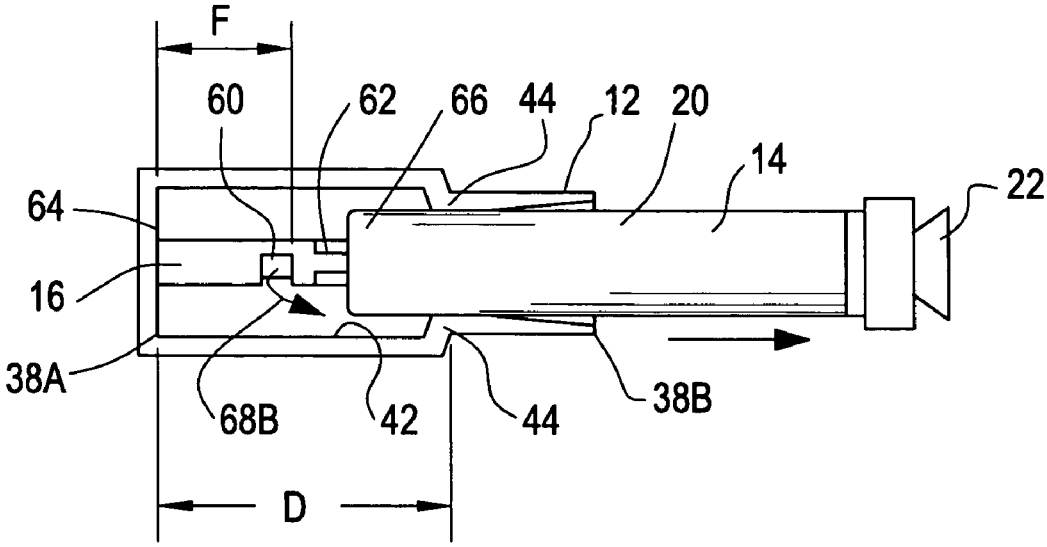
FIG. 8 is a broken away, partial cross-sectional view of the barrel of the toy gun of FIG. 1 illustrating the elongated dart moving off of the inner post within the barrel during the launch of the dart.

As best shown in FIG. 1, it is also preferred that a portion 56 of an inner surface of the restriction 44 that extends to the second end 38B of the barrel 12 flares radially outwardly from the longitudinal axis 46 of the barrel 12. As best shown in FIGS. 7 and 8, it is preferred that the restriction 44 is adapted to contact a side portion of the elongated dart 14.

The inner post 16 is preferably positioned in the chamber 40 and is located at the first end 38A of the barrel to receive pressurized air provided to the barrel 12 for release inside of the chamber 40 at a location spaced from the first end 38A of the barrel 12. The inner post 16 may be formed by multiple posts or may be positioned off center without departing from the present invention. The inner post 16 may include a bore 58 through which the pressurized air is communicated from the first end 38A of the barrel to at least one hole 60 in the inner post 16 through which air is released inside the chamber 40. It is preferred that the at least one hole 60 is located approximately half way between the first end 38A of the barrel 12 and the restriction 44. The inner post 16 can extend past the at least one hole 60 away from the first end 38A of the barrel 12.

Figure 6:
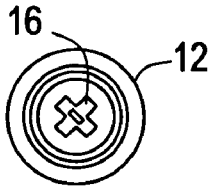
FIG. 6 is an end view of the barrel of the toy gun of FIG. 1 illustrating an X-shaped cross-section of a portion of an inner post located within the barrel.

As best shown in FIGS. 3 and 8, a portion 62 of the inner post 12 on an opposite side of the at least one hole 60 from the first end 38A of the barrel 12 may be grooved. As shown in FIG. 6, the portion 62 of the inner post 16 may have an X-shaped cross-section as taken generally perpendicularly to the longitudinal axis 46 of the barrel 12. Referring again to FIG. 3, in some cases, the inner post 16 may extend through at least part of the restriction 44 in the barrel 12. The inner post 16 may be omitted from the toy gun 10 without departing from the scope of the present invention.

Referring to FIGS. 7 and 8, the inner post 16 and the inner surface 42 of the barrel 12 form a generally annular space 64 to receive an end portion 66 of the elongated dart 14 therein with a portion of the inner post 16 being locatable in the rear bore 24 of the elongated dart 14 so that the pressurized air released through the inner post 16 initially pressurizes the rear bore 24 of the elongated dart 14 and pressurizes the chamber 40 outside of the elongated dart 14 between the first barrel end 38A and the restriction 44 as the dart 14 passes off of the inner post 16. The space 64 can be non-annular without departing from the scope of the present invention.

Referring specifically to FIG. 7, when the compressed/pressurized air exits the inner post 16 through the at least one hole 60, there are two general pressurized air flow paths 68A, 68B. Pressurized air moving generally along the first flow path 68A fills the rear bore 24 and pushes the dart 14 forward. Pressurized air moving generally along the second flow path 68B enters the chamber 40. Referring to FIG. 8, when the dart 14 has moved off of the inner post 16 to the extent necessary for the at least one hole 60 to be uncovered, only the second air flow path 68B remains and all pressurized air enters the chamber 40 directly.

In conventional dart guns, generally no forward discharging force is exerted upon the dart once the dart moves past the at least one hole 60. With the present invention, the seal generally formed between the dart 14 and the restriction 44 results in the air inside the chamber 40 between the first barrel end 38A and the restriction 44 continuing to push the dart forward. This increases the acceleration time to a point when the end of the dart 14 has traveled to a distance "D". The acceleration distance "D" is longer than the prior art acceleration length "F" for the known prior art dart guns. This increase in acceleration distance results in the dart 14 having an increased exit velocity from the barrel 12. This results in the dart 14 flying farther than conventional toy gun darts without requiring an increase in the pressure provided by the air pressure source 26.

The present invention also includes a method of using pressurized air to launch the elongated dart 14 from the toy gun 10. The method includes loading the elongated dart 14 into the barrel 12 of the toy gun 10. The barrel 12 defines the chamber 40 and the first barrel end 38A receives pressurized air. It is preferred that the step of loading the dart 14 include positioning the elongated dart 14 over the inner post 16 positioned in the chamber 40 and located at the first end 38A of the barrel 12 to receive the pressurized air provided to the barrel 12 for release inside the chamber 40 at a located spaced from the first end 38A of the barrel 12. The inner post 16 and the inner surface 42 of the barrel 12 form the annular space 64 which receives the end portion 66 of the elongated dart 14 therein, with a portion 62 of the inner post 16 located in the rear bore 24 of the elongated dart 14.

A portion of the barrel 12 is restricted proximate to the second barrel end 38B to reduce a barrel cross-section 50, as taken in a direction generally perpendicular to the longitudinal axis 46 of the barrel 12, to increase the pressure with which the elongated dart 14 is launched. The pressurized air is released into the rear bore 24 of the elongated dart 14 and into a portion of the chamber 40 between the first end 38A and the restriction 44 so that the elongated dart 14 remains pressurized and continues to accelerate until the end moves past the restriction 44.

Referring to FIGS. 1-8, the preferred embodiment of the present invention operates as follows. A rear bore elongated dart 14 is inserted into the toy gun barrel 12 so that the end portion 66 of the dart 14 is position in the annular space 64 with an inner post 16 extending into the rear bore 24 of the dart 14. A trigger mechanism 36 is activated to cause pressurized air from the air pressure source 26 to be communicated to the inner post 16. The pressurized air exits the inner post through the at least one hole 60 and fills the rear bore 24 of the dart 14 and a portion of the chamber 40 between the first barrel end 38A and the restriction 44. While the dart 14 is moving off the inner post 16, the dart 14 moves completely past the at least one hole 60 which results in the pressurized air in the inner post continuing to fill a portion of the chamber 40 between a first barrel end 38A and the restriction 44. This continues the darts acceleration until the dart 14 is past the restriction 44.

It is recognized by those skilled in the art that changes may be made to the above described embodiment of the present invention without departing from the broad invention concept thereof. For example, the elongated dart 14 and/or barrel 12 can have a polygonal or irregular cross-sectional shape as long as the dart 14 and the restriction 44 have cooperatively abutting surfaces to generally form a seal therebetween. Additionally, the inner post can be omitted without departing from the scope of the present invention. It is understood, therefore, that this invention is not limited to the particular embodiment disclosed, but is intended to cover all modifications which are within the spirit and scope of the invention as defined by the amended claims and/or shown in the attached drawings.

What is claimed is:

1. A toy gun that uses pressurized air to launch an elongated dart, comprising:

an air pressure source;

a trigger mechanism for selective control of the air pressure source;

a barrel in communication with the air pressure source and having first and second ends, the first end positioned to receive pressurized air from the air pressure source upon activation of the trigger mechanism, the barrel defining a chamber adapted to receive the elongated dart;

an elongated dart having a rear bore located in the chamber;

the barrel having an inner surface with a restriction proximate to the second end, the restriction reduces a barrel cross-section, taken in a direction generally perpendicular to a longitudinal axis of the barrel, to a size corresponding to a size of the elongated dart; and an inner post positioned in the chamber and located at the first end of the barrel to receive pressurized air provided to the barrel for release inside the chamber at a location spaced from the first end of the barrel, the inner post and the inner surface of the barrel forming an annular space that receives an end portion of the elongated dart therein with a portion of the inner post located in the rear bore of the elongated dart so that the pressurized air released through the inner post initially pressurizes the rear bore of the elongated dart and pressurizes the chamber outside of the elongated dart between the first end and the restriction as the dart passes off of the inner post.

2. The toy gun of claim 1, wherein the restriction is adapted to contact a side portion of the elongated dart.

3. A toy gun that uses pressurized air to launch an elongated dart having a rear bore, comprising:

an air pressure source;

a trigger mechanism for selective control of the air pressures source;

a barrel in communication with the air pressure source and having first and second ends, the first end positioned to receive pressurized air from the air pressure source upon activation of the trigger mechanism, the barrel defining a chamber adapted to receive the elongated dart;

the barrel having an inner surface with a restriction proximate to the second end, the restriction reduces a barrel cross-section, taken in a direction generally perpendicular to a longitudinal axis of the barrel, to a size corresponding to the elongated dart;

an inner post positioned in the chamber and located at the first end of the barrel to receive pressurized air provided to the barrel for release inside the chamber at a location spaced from the first end of the barrel, the inner post and the inner surface of the barrel forming an annular space to receive an end portion of the elongated dart therein with a portion of the inner post locatable in the rear bore of the elongated dart so that the pressurized air released through the inner post initially pressurizes the rear bore of the elongated dart and pressurizes the chamber outside of the elongated dart between the first end and the restriction as the dart passes off of the inner post; and the inner post includes a bore through which the pressurized air is communicated from the first end of the barrel to at least one hole in the inner post through which air is released inside the chamber, the at least one hole being located approximately halfway between the first end of the barrel and the restriction.

4. The toy gun of claim 3, wherein the inner post extends past the at least one hole away from the first end of the barrel.

5. The toy gun of claim 4, wherein a portion of the inner post on an opposite side of the at least one hole from the first end of the barrel is grooved.

6. The toy gun of claim 4, wherein a portion of the inner post has an X-shaped cross-section, as taken generally perpendicularly to the longitudinal axis of the barrel.

7. The toy gun of claim 3, wherein the inner post extends through at least part of the restriction in the barrel.

8. The toy gun of claim 1, wherein a restriction cross-sectional area, as measured generally perpendicularly to the longitudinal axis of the barrel, is between approximately fifty (50%) percent and approximately seventy (70%) percent of an unrestricted barrel cross-sectional area, as measured generally perpendicularly to the longitudinal axis.

9. The toy gun of claim 1, wherein a restriction cross-sectional area, as measured generally perpendicularly to the longitudinal axis of the barrel, is between approximately sixty (60%) percent and approximately sixty-five (65%) percent of an unrestricted barrel cross-sectional area, as measured generally perpendicularly to the longitudinal axis.

10. The toy gun of claim 1, wherein a length of the restriction, as measured generally parallel to the longitudinal axis of the barrel, is between approximately ten (10%) percent and approximately thirty (30%) percent of a length of the barrel, as measured generally parallel to the longitudinal axis.

11. The toy gun of claim 1, wherein a length of the restriction, as measured generally parallel to the longitudinal axis of the barrel, is approximately twenty (20%) percent of a length of the barrel, as measured generally parallel to the longitudinal axis.

12. The toy gun of claim 1, wherein a portion of an inner surface of the restriction that extends to the second end of the barrel flares radially outwardly from the longitudinal axis of the barrel.

13. A toy gun that uses pressurized air to launch an elongated dart, comprising;

an air pressure source;

a trigger mechanism for selective control of the air pressure source;

a barrel in communication with the air pressure source and having first and second ends, the first end positioned to receive pressurized air from the air pressure source upon activation of the trigger mechanism, the barrel defining a chamber adapted to receive the elongated dart;

an elongated dart with a rear bore located in the chamber;

the barrel having an inner surface with a restriction proximate to the second end, the restriction reduces a barrel cross-section, taken in a direction generally perpendicular to a longitudinal axis of the barrel, to a size corresponding to a size of the elongated dart; and an inner post positioned in the chamber and located at the first end of the barrel to receive pressurized air provided to the barrel for release inside the chamber at a location spaced from the first end of the barrel, the inner post and the inner surface of the barrel forming a space therebetween that receives an end portion of the elongated dart therein with a portion of the inner post located in the rear bore of the elongated dart so that the pressurized air released through the inner post initially pressurizes the rear bore of the elongated dart and pressurizes the chamber outside of the elongated dart between the first end and the restriction as the dart passes off of the inner post.

14. The toy gun of claim 13, wherein a portion of an inner surface of the restriction that extends to the second end of the barrel flares radially outwardly from the longitudinal axis of the barrel.

15. A toy gun that uses pressurized air to launch an elongated dart having a rear bore, comprising:

an air pressure source;

a trigger mechanism for selective control of the air pressure source;

a barrel in communication with the air pressure source and having first and second ends, the first end positioned to receive pressurized air from the air pressure source upon activation of the trigger mechanism, the barrel defining a chamber adapted to receive the elongated dart;

the barrel having an inner surface with a restriction proximate to the second end, the restriction reduces a barrel cross-section, taken in a direction generally perpendicular to a longitudinal axis of the barrel, to a size corresponding to the elongated dart;

an inner post positioned in the chamber and located at the first end of the barrel to receive pressurized air provided to the barrel for release inside the chamber at a location spaced from the first end of the barrel, the inner post and the inner surface of the barrel forming a space therebetween to receive an end portion of the elongated dart therein with a portion of the inner post locatable in the rear bore of the elongated dart so that the pressurized air released through the inner post initially pressurizes the rear bore of the elongated dart and pressurizes the chamber outside of the elongated dart between the first end and the restriction as the dart passes off of the inner post; and the inner post includes a bore through which the pressurized air is communicated from the first end of the barrel to at least one hole in the inner post through which air is released inside the chamber, the at least one hole being located approximately halfway between the first end of the barrel and the restriction.

16. The toy gun of claim 15, wherein the inner post extends past the at least one hole away from the first end of the barrel.

17. The toy gun of claim 16, wherein a portion of the inner post on an opposite side of the at least one hole from the first end of the barrel is grooved.

18. The toy gun of claim 16, wherein a portion of the inner post has an X-shaped cross-section, as taken generally perpendicularly to the longitudinal axis of the barrel.

19. The toy gun of claim 13, wherein the inner post extends through at least part of the restriction in the barrel.

* * * * *

UNITED STATES PATENT AND TRADEMARK OFFICE

CERTIFICATE OF CORRECTION

PATENT NO. : 7,537,001 B2
APPLICATION NO. : 11/100694
DATED : May 26, 2009
INVENTOR(S) : Chor Ming Ma It is certified that error appears in the above-identified patent and that said Letters Patent is hereby corrected as shown below:

In claim 3, at column 6, line 28, after the word "air", delete "pressures" and insert therefor --pressure--.

In claim 13, at column 7, line 28, after the word "dart", delete "comprising;" and insert therefor --comprising:--.

Signed and Sealed this

Twentieth Day of October, 2009

David J. Kappos

David J. Kappos
*Director of the United States Patent and Trademark Office*